US010380820B2

(12) United States Patent
Powers

(10) Patent No.: US 10,380,820 B2
(45) Date of Patent: Aug. 13, 2019

(54) INCREASED CAPACITY COIN HOPPER

(71) Applicant: TIDEL ENGINEERING L.P., Carrollton, TX (US)

(72) Inventor: Doug Powers, Keller, TX (US)

(73) Assignee: TIDEL ENGINEERING L.P., Carrollton, TX (US)

( * ) Notice: Subject to any disclaimer, the term of this patent is extended or adjusted under 35 U.S.C. 154(b) by 0 days.

(21) Appl. No.: 14/842,596

(22) Filed: Sep. 1, 2015

(65) Prior Publication Data

US 2016/0189462 A1 Jun. 30, 2016

Related U.S. Application Data

(60) Provisional application No. 62/097,526, filed on Dec. 29, 2014.

(51) Int. Cl.

| | |
|---|---|
| ***G07D 9/00*** | (2006.01) |
| ***G07D 9/04*** | (2006.01) |
| ***G07D 3/12*** | (2006.01) |

(52) U.S. Cl.

CPC ..... *G07D 9/04* (2013.01); *G07D 3/128* (2013.01); *G07D 9/008* (2013.01)

(58) Field of Classification Search

CPC ..... G07D 3/128; G07D 9/04; G07D 9/008

USPC ..... 453/6, 10, 12, 13, 33, 34, 35, 49, 57; 235/379

See application file for complete search history.

(56) References Cited

U.S. PATENT DOCUMENTS

| | | | | |
|---|---|---|---|---|
| 1,350,148 | A * | 8/1920 | Garami | G07D 1/00 453/19 |
| 2,843,293 | A * | 7/1958 | Burgoyne | A47J 31/401 222/129.4 |
| 3,381,446 | A * | 5/1968 | Marchand | B65B 39/145 53/385.1 |
| 5,161,736 | A | 11/1992 | Roccoberton | |
| 5,531,640 | A * | 7/1996 | Inoue | G07D 9/008 453/17 |
| 6,569,006 | B1 * | 5/2003 | Kurosawa | G07D 9/008 453/13 |
| 9,092,924 | B1 * | 7/2015 | Rasmussen | G07D 3/00 |
| 2001/0055999 | A1 * | 12/2001 | Bush | A63B 69/0071 473/433 |
| 2003/0234153 | A1 * | 12/2003 | Blake | G07D 3/128 194/347 |

(Continued)

OTHER PUBLICATIONS

U.S. Appl. No. 14/842,620, filed Sep. 1, 2015, Moreland, Flynt, et al.

(Continued)

*Primary Examiner* — Jeffrey A Shapiro
(74) *Attorney, Agent, or Firm* — Polsinelli PC

(57) ABSTRACT

Implementations described and claimed herein involve systems and methods for handling an increased capacity of coins. In one implementation, an increased capacity coin hopper assembly comprises a bucket assembly, a coin hopper, and a funnel assembly. The bucket assembly has an opening through which one or more coins are receivable, and the coin hopper has a payout disc rotatable by at least one motor. The funnel assembly is disposed between the bucket assembly and the coin hopper and directs the one or more coins from the bucket assembly to the payout disc with a controlled flow.

19 Claims, 16 Drawing Sheets

(56) References Cited

U.S. PATENT DOCUMENTS

| | | | | |
|---|---|---|---|---|
| 2004/0072528 | A1* | 4/2004 | Kurosawa | G07D 9/008 453/33 |
| 2005/0197054 | A1* | 9/2005 | Deitz | G07D 9/065 453/61 |
| 2007/0187897 | A1* | 8/2007 | Dilling | A63B 63/00 273/407 |
| 2010/0210379 | A1* | 8/2010 | Shelley | A63B 63/083 473/433 |
| 2010/0234985 | A1* | 9/2010 | Shuren | G07F 9/08 700/223 |
| 2011/0030312 | A1* | 2/2011 | Wonka | G07D 1/00 53/167 |
| 2011/0117827 | A1 | 5/2011 | Chang | |
| 2011/0130225 | A1* | 6/2011 | Sims | A63B 63/083 473/433 |

OTHER PUBLICATIONS

Nonfinal Office Action in U.S. Appl. No. 14/842,620 dated Jun. 8, 2016.
Response to Nonfinal Office Action in U.S. Appl. No. 14/842,620 filed Nov. 10, 2016.

* cited by examiner

100

INCREASED CAPACITY COIN HOPPER

CROSS-REFERENCE TO RELATED APPLICATIONS

The present application claims benefit under 35 U.S.C. § 119(e) to U.S. Provisional Patent Application No. 62/097,526, entitled "INCREASED CAPACITY COIN HOPPER" and filed on Dec. 29, 2014, which is specifically incorporated by reference herein in its entirety.

TECHNICAL FIELD

Aspects of the present disclosure relate to coin payout systems and methods and more particularly to a coin hopper configured to handle a higher coin capacity.

BACKGROUND

Gaming, vending, amusement, industrial, and retail industries, among others, utilize coin hoppers to provide coin counter and payout systems. Generally, coin hoppers receive coins in a coin bin, and the coins fall onto a payout disc where they are rotated by a motor for counting and payout. Many conventional coin hoppers are limited in the capacity of coins they are configured to handle. For example, some conventional coin hoppers are configured to handle approximately 400-1000 coins. Attempting to increase the coin capacity in such coin hoppers often prevents the motor from turning due to the weight of the excess coins on the payout disc and/or creates coin jams. On the other hand, coin hoppers with an increased coin capacity are cost prohibitive. It is with these observations in mind, among others, that various aspects of the present disclosure were conceived and developed.

SUMMARY

Implementations described and claimed herein address the foregoing problems by providing systems and methods for handling an increased capacity of coins. In one implementation, an increased capacity coin hopper assembly comprises a bucket assembly, a coin hopper, and a funnel assembly. The bucket assembly has an opening through which one or more coins are receivable, and the coin hopper has a payout disc rotatable by at least one motor. The funnel assembly is disposed between the bucket assembly and the coin hopper and directs the one or more coins from the bucket assembly to the payout disc with a controlled flow.

In another implementation, one or more coins are received through an opening in a bucket assembly and are directed onto an inner surface of a funnel using one or more angled surfaces of the bucket assembly. A flow of the one or more coins into a bin of a coin hopper is controlled with the inner surface of the funnel. The one or more coins are distributed onto a payout disc of the coin hopper with a nozzle connected to the funnel.

In still another implementation, an increased capacity coin hopper comprises a funnel and a nozzle. The funnel has a contoured portion sloping distally from a rim to a distal end. A hole is defined by the distal end of the funnel. The nozzle has a body extending from a proximal edge to a distal edge. The proximal edge of the nozzle is connected to the contoured portion of the funnel, and the distal edge of the nozzle is disposed near a surface of a coin hopper. An opening extends through the body of the nozzle from the proximal edge to the distal edge.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Aspects of the present disclosure generally involve a relatively inexpensive coin hopper assembly configured to handle an increased coin capacity. In one aspect, the coin hopper assembly includes a bucket assembly and a base assembly. The bucket assembly comprises a bucket formed by front, back, and side panels and interior surfaces. The interior surfaces of the bucket include angled surfaces to direct coins into a funnel assembly, which controls a flow of the coins released into a bin of a coin hopper enclosed by the base assembly.

The coins are received onto a payout disc of the coin hopper, which is rotated by a motor for counting and payout of the coins. A coin insert plate hooks each of the coins and directs them to an exit chute. The controlled flow created by the funnel assembly permits the coin hopper to handle an increased capacity of coins (e.g., approximately 4,000 coins) while allowing the motor to turn the payout disc uninhibited. To prevent coin jams due to excess coins sitting on the payout disc, the funnel assembly includes a funnel connected to a nozzle made from a flexible plastic netting. The nozzle is configured to flex out of the way when meeting a stack of coins while slowing the flow of coins onto the payout disc. The nozzle may be shaped and sized to match a slope of the coin hopper to maximize the amount of coins it manages.

Figure 1:
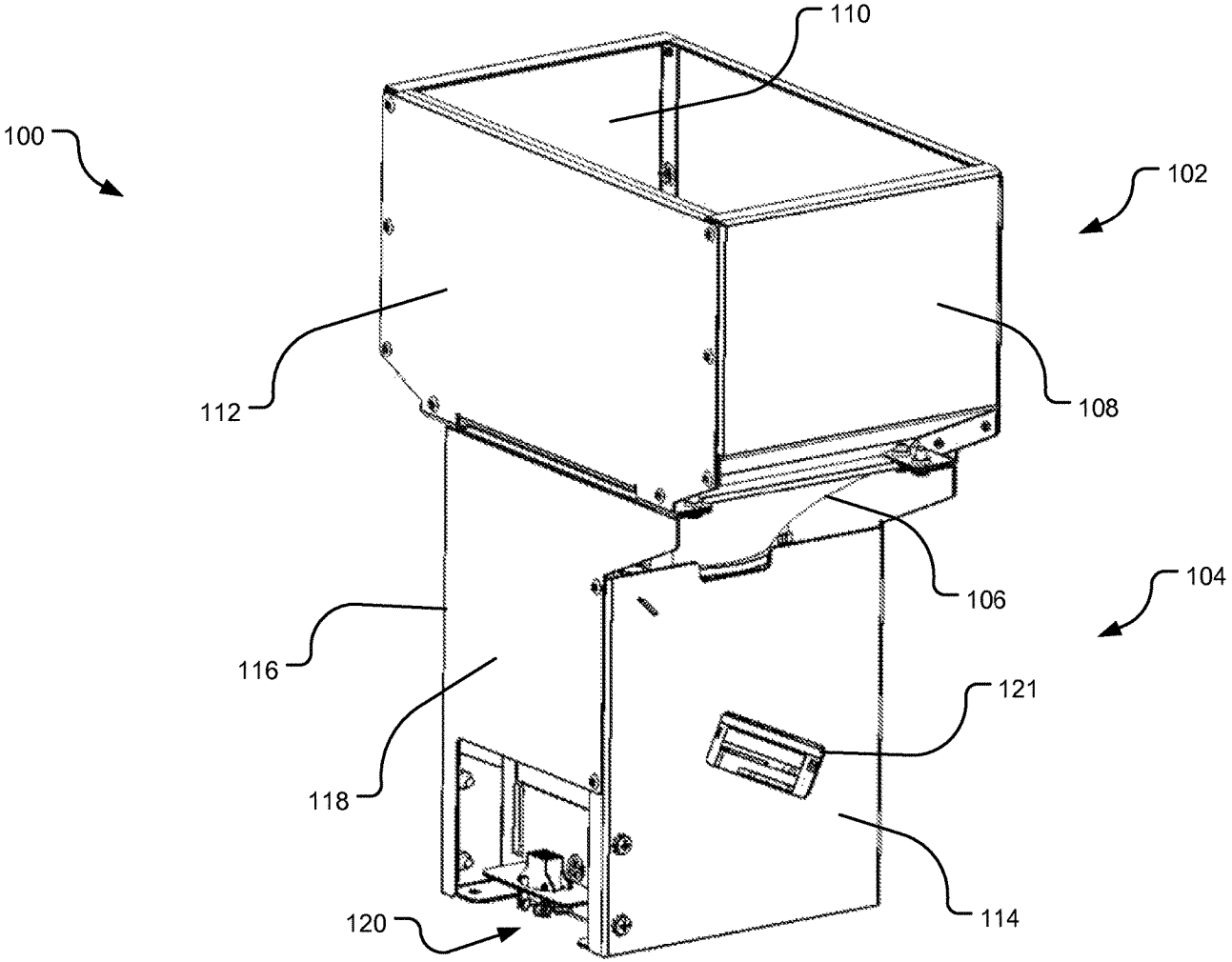
FIG. 1 illustrates a perspective view of an example increased capacity coin hopper assembly.
Figure 2:
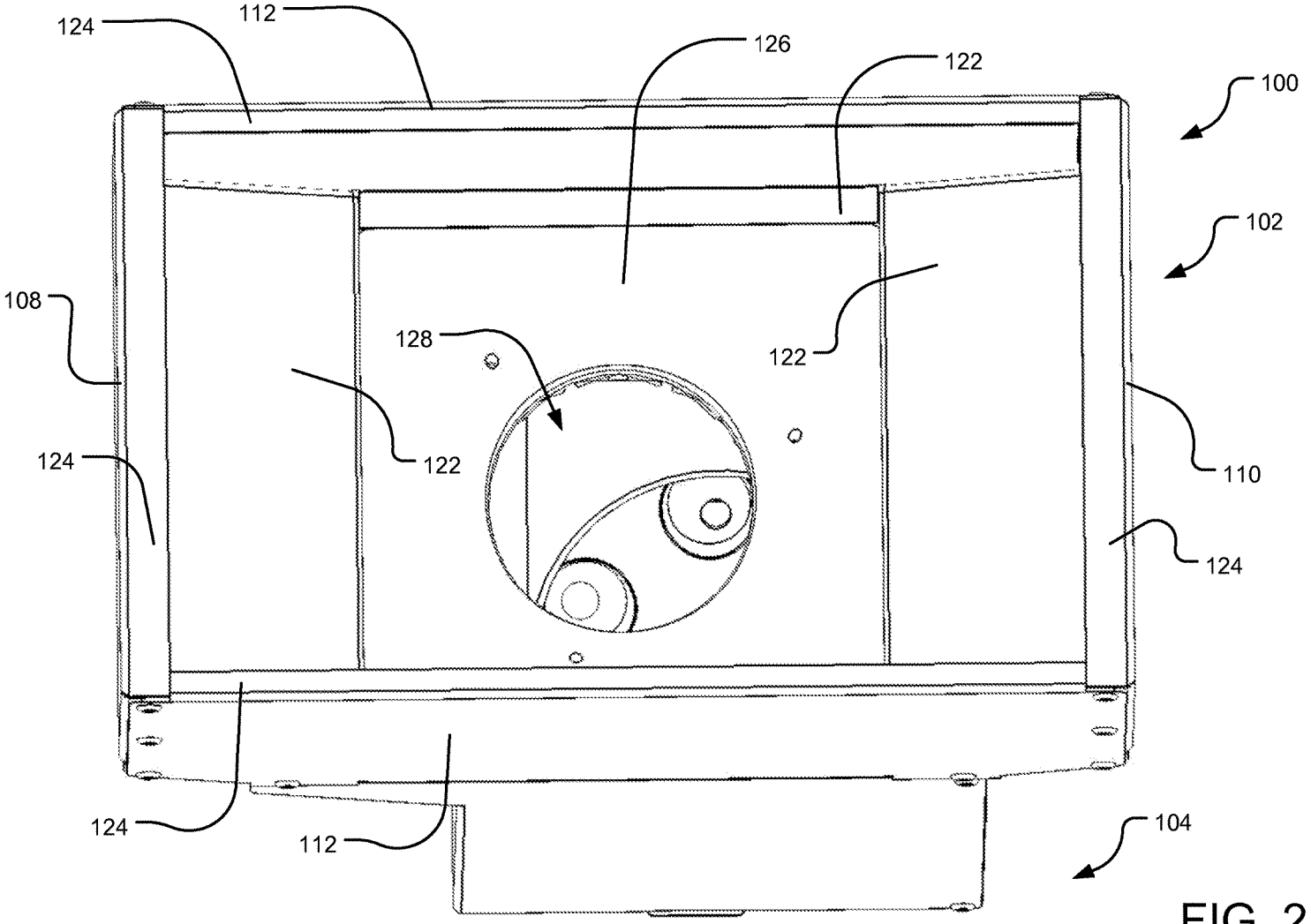
FIG. 2 shows a top view of the coin hopper assembly.
Figure 3:
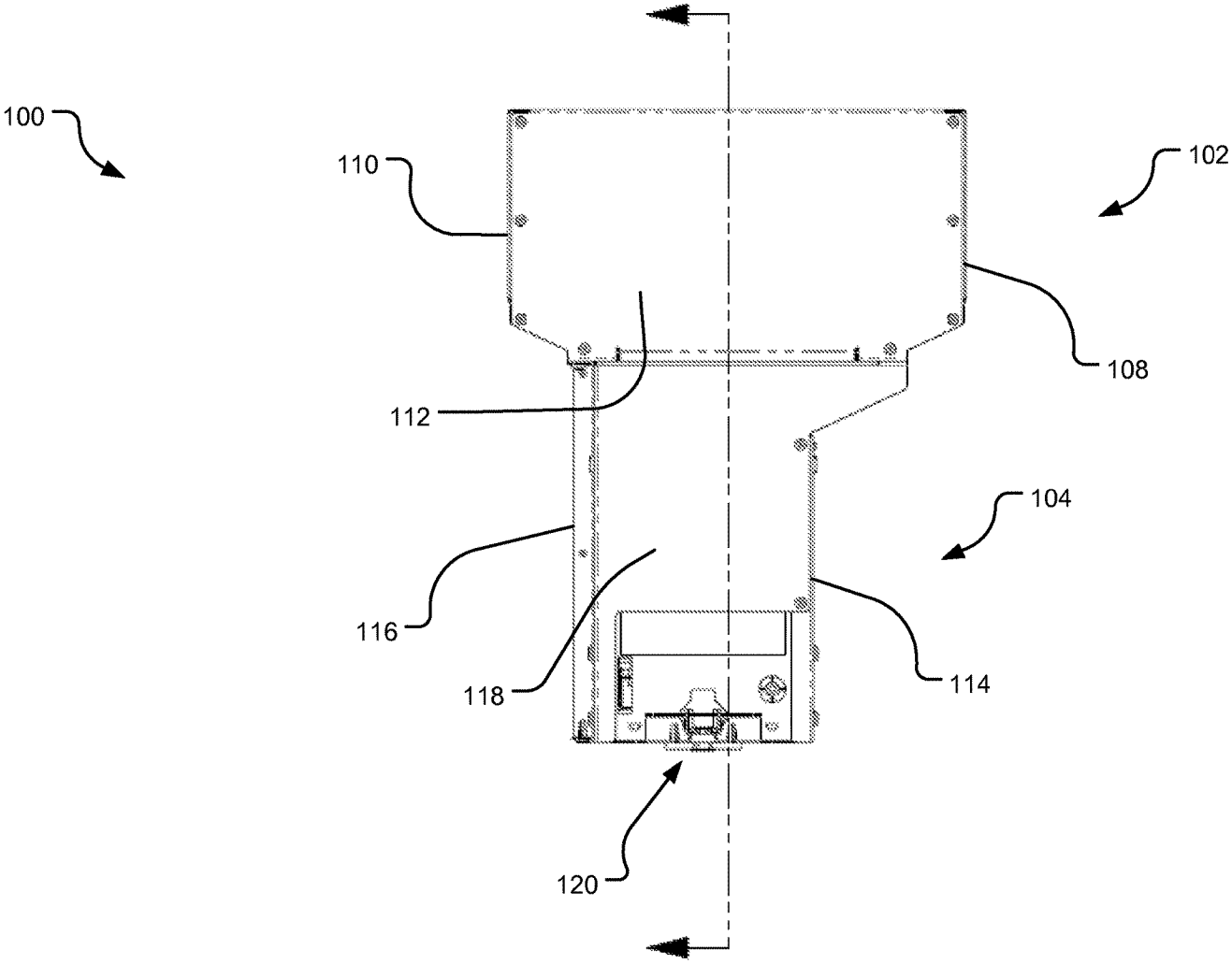
FIG. 3 is a side view of the coin hopper assembly.

To begin a detailed description of an example increased capacity coin hopper assembly, reference is made to FIGS. 1-3, which show perspective, top, and side views of a coin hopper assembly 100, respectively. In one implementation, the coin hopper assembly 100 includes a bucket assembly 102, a base assembly 104, and a funnel assembly 106. The bucket assembly 102 is disposed at a proximal end of the coin hopper assembly 100, and the base assembly 104 is disposed at a distal end of the coin hopper assembly 100.

In one implementation, the bucket assembly 102 includes a bucket having an opening configured to receive coins into an interior of the bucket. The bucket may be a variety of shapes and sizes, including, without limitation, cubical, hexahedral, spherical, cylindrical, conical, pyramidal, or other polyhedral shapes. In one implementation, the bucket is formed by a front panel 108 disposed generally opposite a back panel 110 and side panels 112 connecting the front panel 108 to the back panel 110. Proximal edges of the panels 108, 110, and 112 form the bucket opening. The panels 108, 110, and 112 may include generally planar, smooth surfaces. However, other surface shapes and textures are contemplated.

The funnel assembly 106 is disposed between the bucket assembly 102 and the base assembly 104 to direct coins received in the bucket assembly 102 into the base assembly 104 with a controlled flow. The base assembly 104 may be a variety of shapes and sizes, including, without limitation, cubical, hexahedral, spherical, cylindrical, conical, pyramidal, or other polyhedral shapes. In one implementation, the base assembly 104 includes a front panel 114, a back panel 116 disposed generally opposite the front panel 114, and a pair of opposing side panels 118. The panels 114, 116, and 118 may include generally planar, smooth surfaces. However, other surface shapes and textures are contemplated. In one implementation, a portion of the side panels 118 extends past the front panel 114 creating an opening to the funnel assembly 106.

As can be understood from FIG. 2, in one implementation, the bucket assembly 102 includes one or more interior surfaces 122. The interior surfaces 122 extend from one or more of the panels 108-112 at an angle configured to receive and direct coins into the funnel assembly 106. In one implementation, the interior surfaces 122 extending from the side panels 112 have a shorter length relative to the interior surfaces 122 extending from the front panel 108 and the back panel 110. The top edges of the panels 108, 110, and 112 may include lips 124 extending inwardly towards a center of the bucket assembly 102 to prevent coin spillage. The lips 124 extending from the side panels 112 may have a shorter length relative to the lips 124 extending from the front panel 108 and the back panel 110.

In one implementation, the funnel assembly 106 is mounted to the bucket assembly 102, such that the interior surfaces 122 transition into an inner surface 126 of the funnel assembly 106 to direct the coins towards a hole 128 defined in the inner surface 126. As described herein, the inner surface 126 tapers distally towards the hole 128 to release the coins into the base assembly 104 with a controlled flow for counting and payout.

The coins are counted and directed to an exit shoot where the coins are routed through an opening in the base assembly 104, such as an opening 121 defined in the front panel 114, as shown in FIG. 1. Such operations of the coin hopper assembly 100, among others, are powered and controlled using a connector 120 disposed in the base assembly 104.

Figure 4:
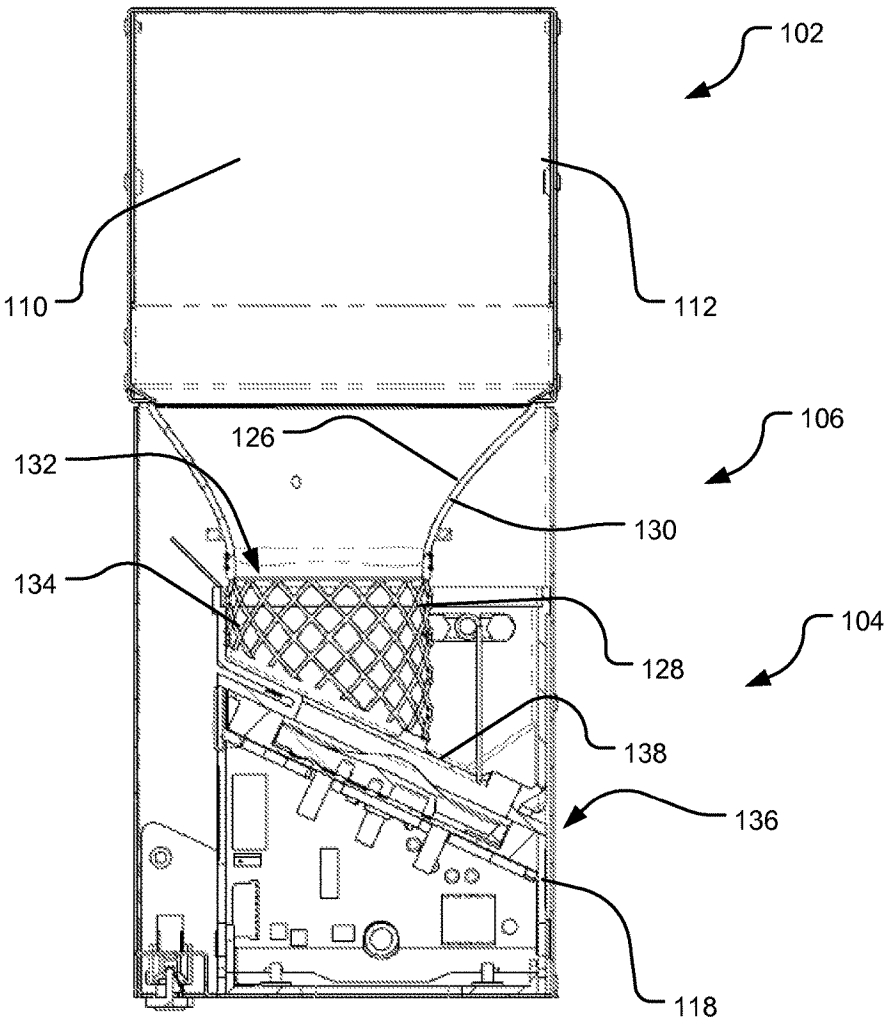
FIG. 4 illustrates a cross sectional view of the coin hopper assembly taken along the line shown in FIG. 3.

Turning to FIG. 4, a cross sectional view of the coin hopper assembly 100 taken along the line shown in FIG. 3 is shown. In one implementation, the funnel assembly 106 includes a funnel 130 having the inner surface 126, which is a contoured surface that narrows to control the flow of coins. Stated differently, the inner surface 126 slopes towards the hole 128 and the funnel 130 has a diameter that tapers along the inner surface 126 from the bucket assembly 102 towards the hole 128.

At the hole 128, a nozzle 134 is connected to the funnel 130. The nozzle 134 includes an opening 132 sized and shaped to match the hole 128 of the funnel 130. In one implementation, the nozzle 134 comprises a netting made from a durable, flexible material, including, but not limited to, plastic, textile material, fabric, leather, and/or the like. The funnel 130 and the nozzle 134 are configured to control the flow of the coins from the bucket assembly 102 into a coin hopper 136 and prevent coin jams.

The controlled flow created by the funnel 130 permits the coin hopper 136 to handle an increased capacity of coins (e.g., approximately 4,000 coins or more). The nozzle 134 is shaped and sized to match a slope of a surface 138 of the coin hopper 136 to maximize the amount of coins the coin hopper 136 manages. The nozzle 134 flexes out of the way when meeting a stack of coins while slowing the flow of coins onto the surface 138.

Figure 5:
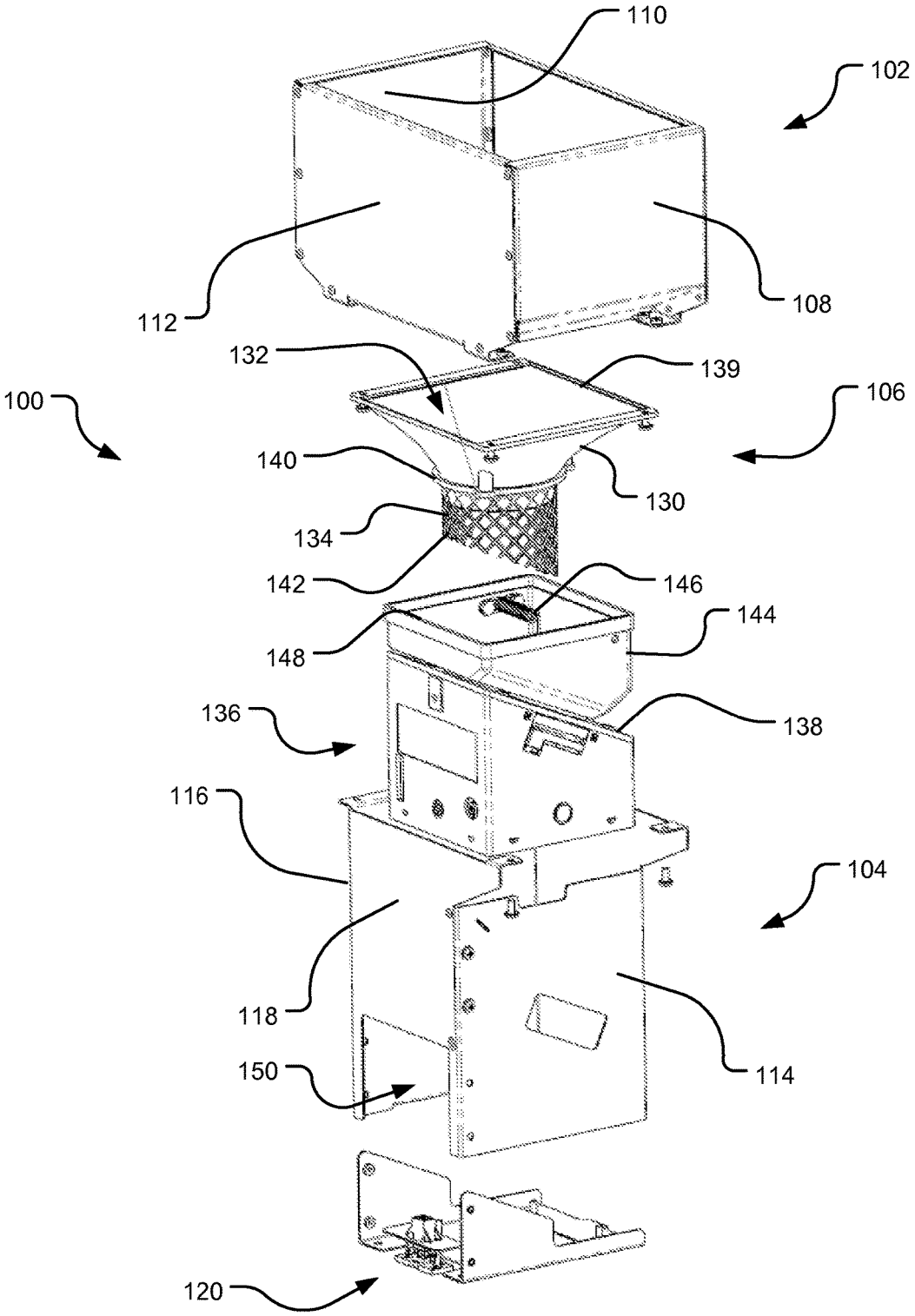
FIG. 5 shows an exploded view of the coin hopper assembly.
Figure 6:
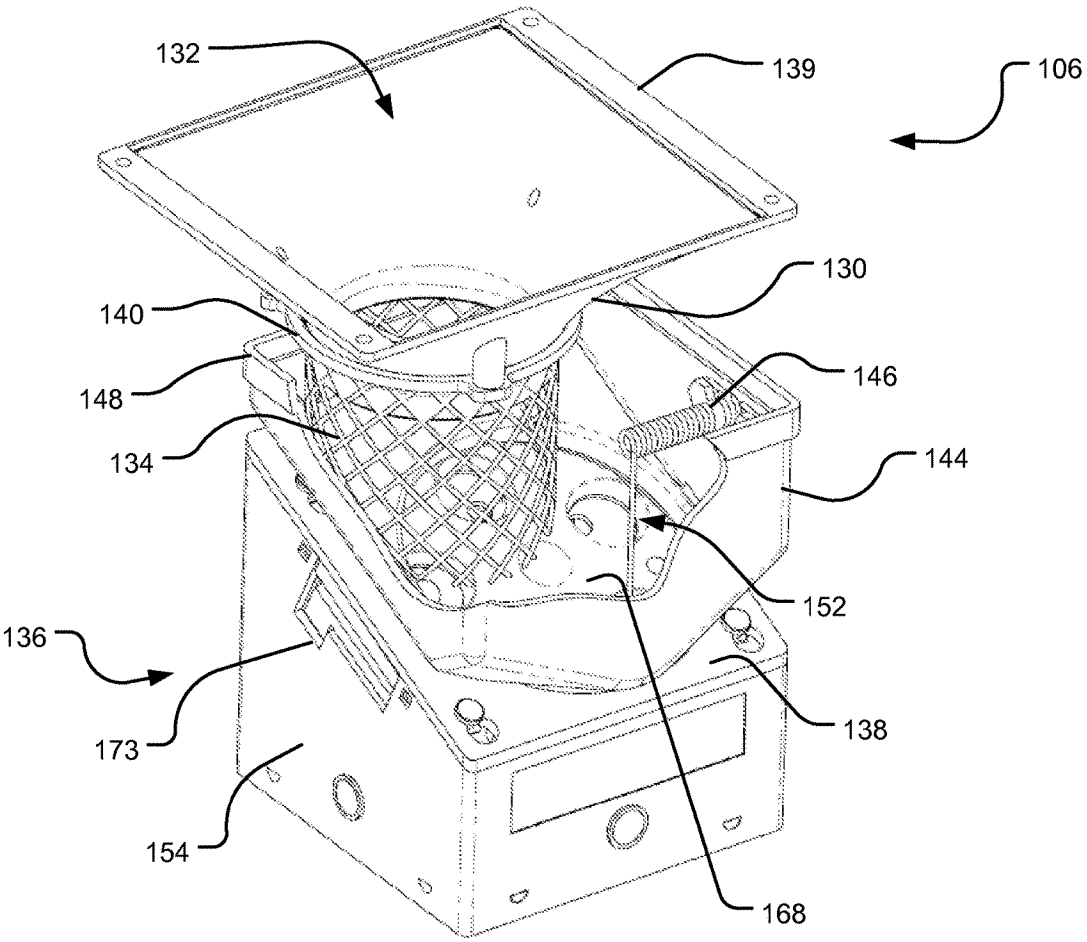
FIG. 6 illustrates an example funnel assembly to control a flow of coins into an example coin hopper, shown with a portion of a bin of the coin hopper removed for clarity.

As can be understood from FIGS. 5 and 6, in one implementation, the funnel 130 includes a rim 139 for mounting the funnel assembly 106 on the bucket assembly 102. The rim 139 may have a variety of shapes, including without limitation, rectangular, circular, elliptical, triangular, polygonal, contoured, and/or angled. In one implementation, the rim 139 is sized and shaped to mirror the interior surfaces 122 of the bucket assembly 102 to form a transition from the bucket assembly 102 into the funnel assembly 106 through the hole 128 and the opening 132.

In one implementation, the opening 132 in the nozzle 134 is defined by a ring 140 configured to engage the funnel 130 near the hole 128. A distal portion of the funnel 130 may extend distally into the opening 132, such that the nozzle 134 and the ring 140 engage the funnel 130 proximally from the hole 128. The nozzle 134 may be a variety of shapes and sizes. For example, the nozzle 134 may be cylindrical in shape with a diameter larger than a diameter of the hole 128. In one implementation, the nozzle 134 includes a distal edge 142 that is angled to mirror a slope of the surface 138 of the coin hopper 136. Stated differently, the distal edge 142 extends parallel to a surface angle of the surface 138 of the coin hopper 136. The angle of the distal edge 142 facilitates distribution of the coins on the surface 138 to prevent coin jams and further control the flow of the coins into the coin hopper 136.

The coin hopper 136 receives the coins from the funnel assembly 106 for counting and payout. In one implementation, the nozzle 134 extends into an opening defined by a proximal edge 148 of a bin 144. As can be understood from FIG. 6, the bin 144 contains the coins on the surface 138 of the coin hopper 136, and the nozzle 134 releases the coins in a controlled flow onto a payout disc 168. In one implementation, a coil spring 146 further disperses the coins on the surface 138 until the coins are received in openings 152 defined in the payout disc 168. Through the openings 152, the coins are received into the coin hopper 136 where the coins are counted and routed through an exit slot 154 for payout.

Figure 7:
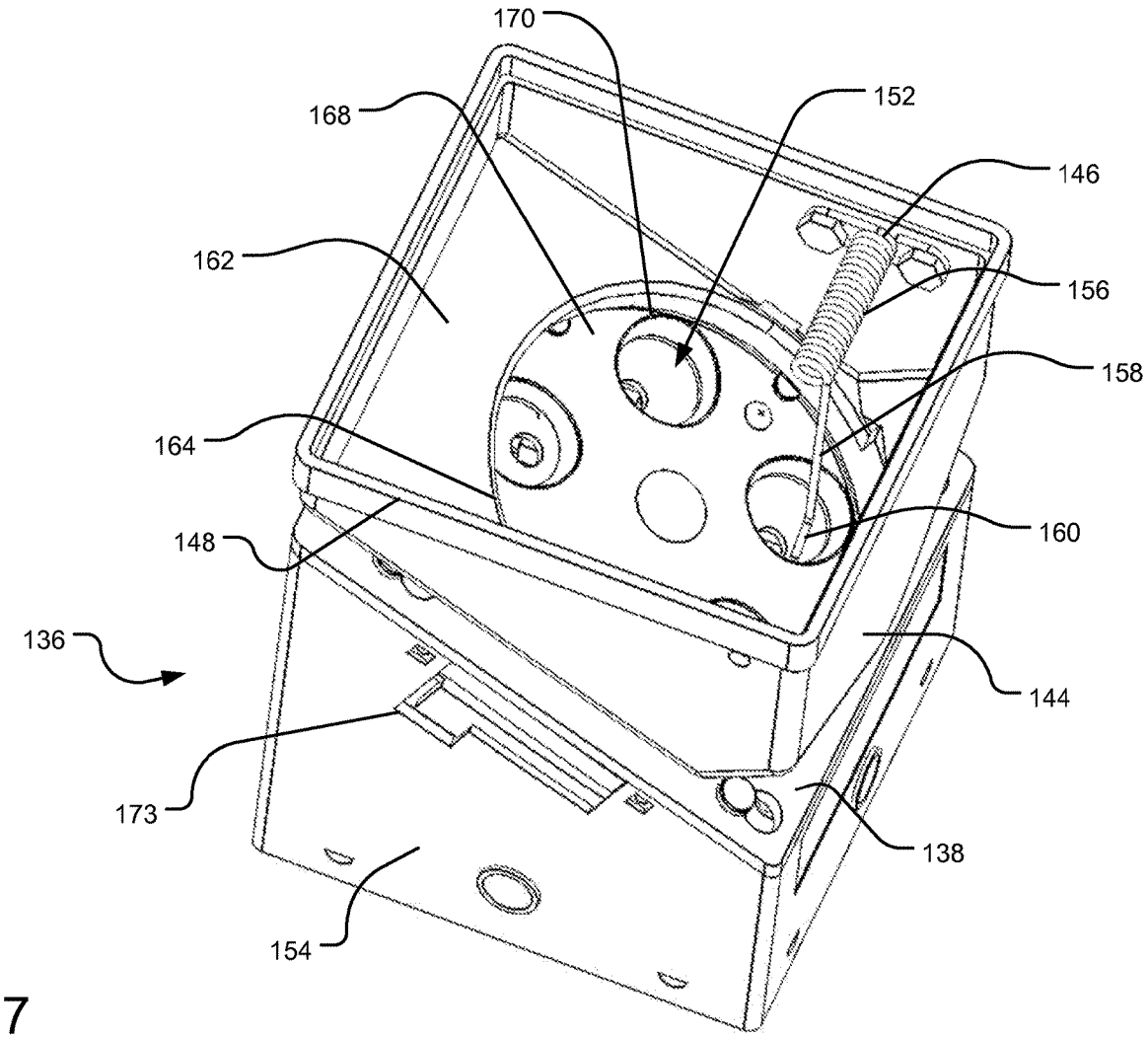
FIGS. 7 and 8 show the coin hopper with the bin shown and removed, respectively.
Figure 8:
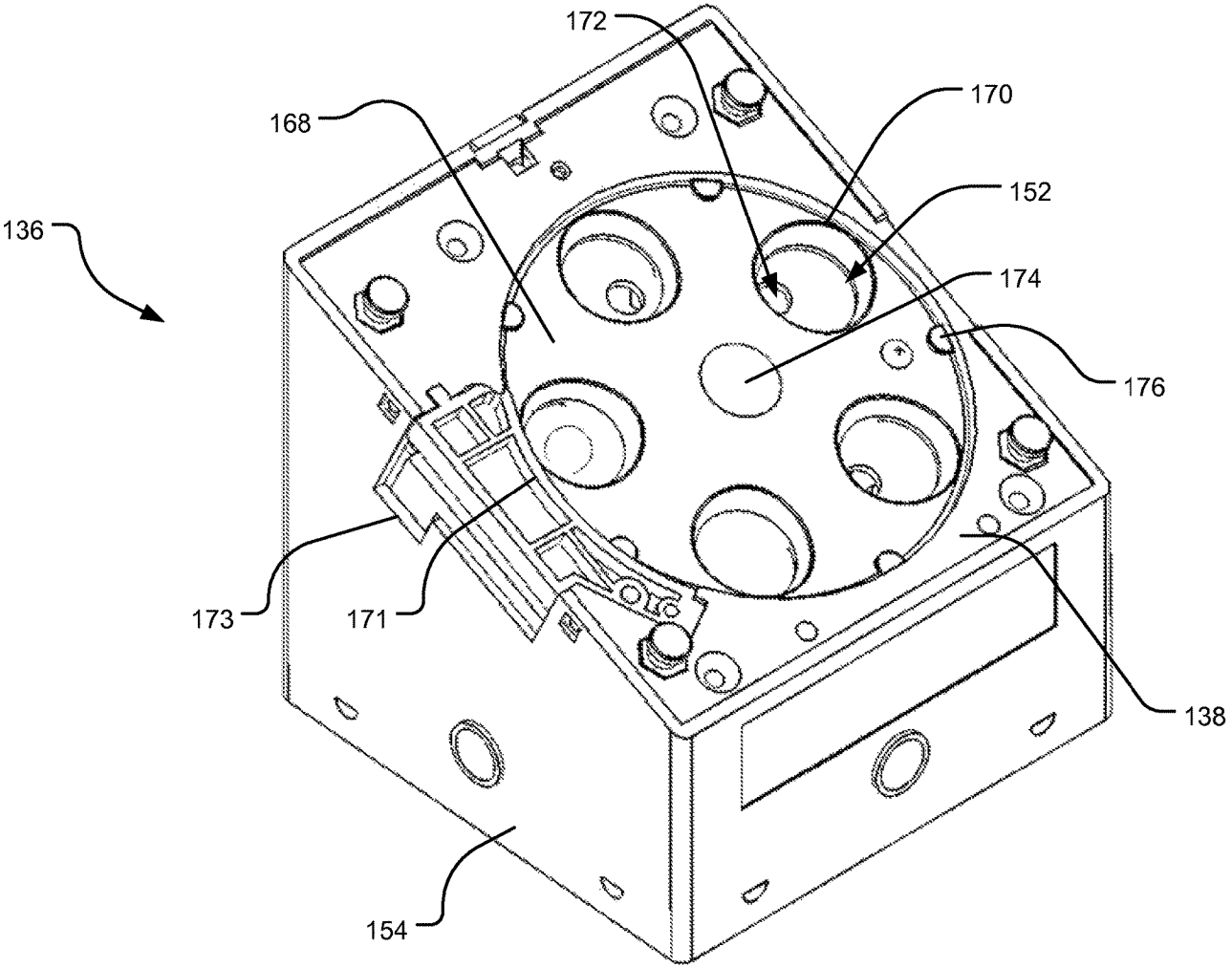
Figure 9:
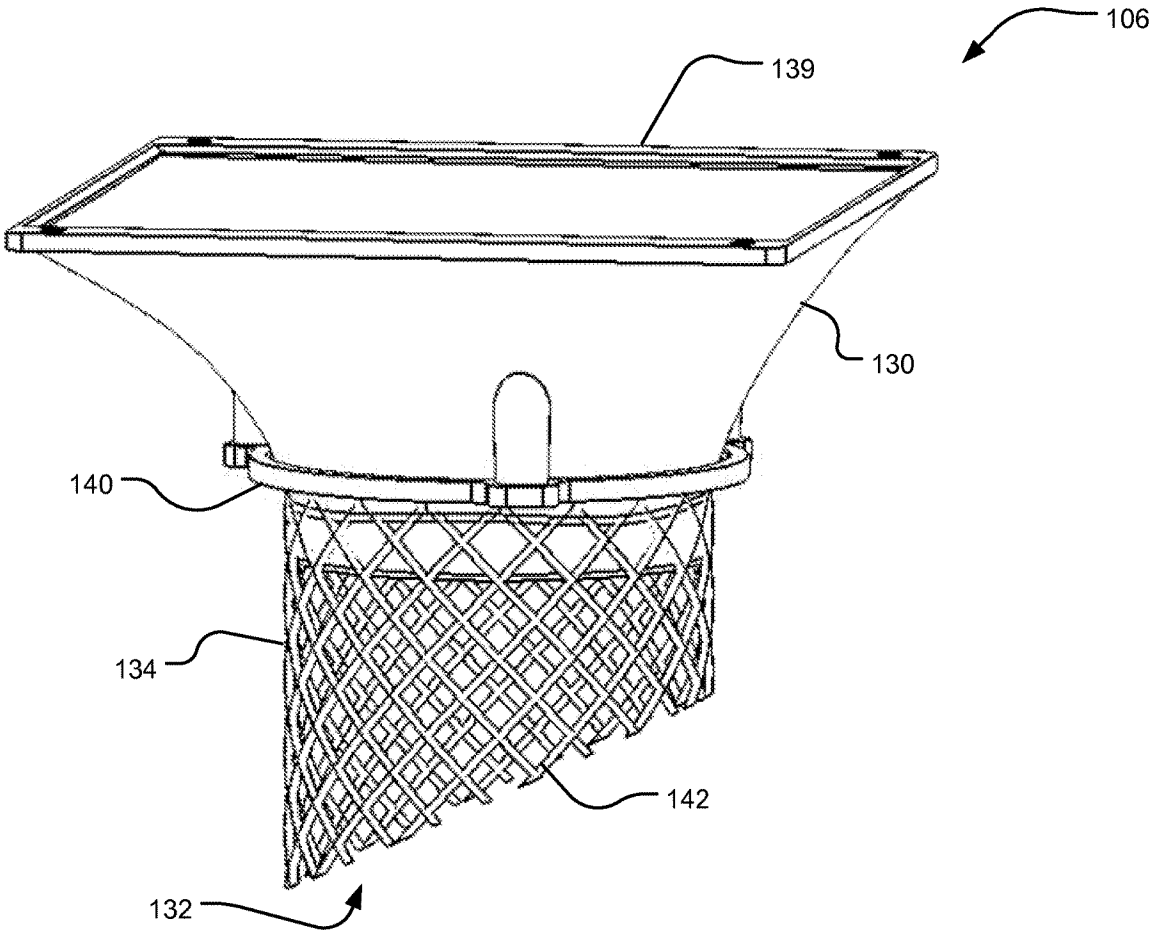
FIGS. 9-11 show a side perspective view, a bottom perspective view, and a side view, respectively, of the funnel assembly, including a funnel and a nozzle connected with a ring.
Figure 10:
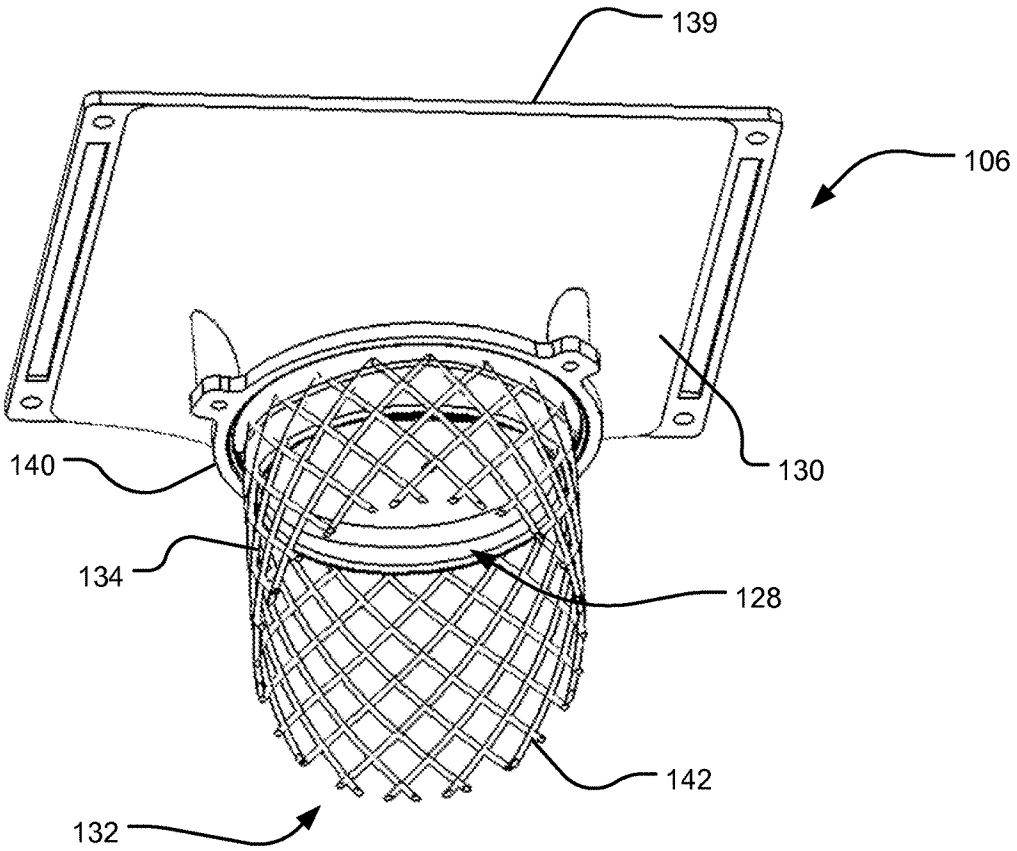
Figure 11:
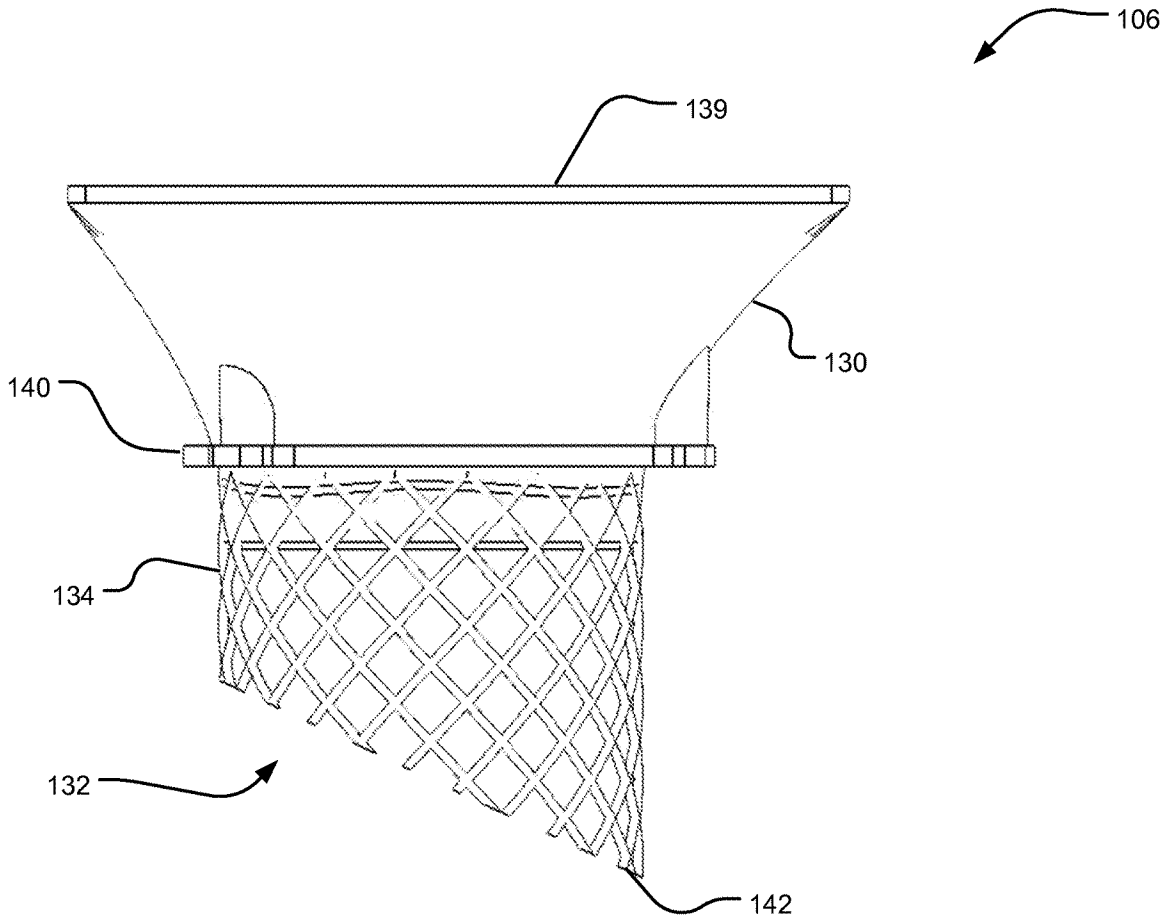
Figure 12:
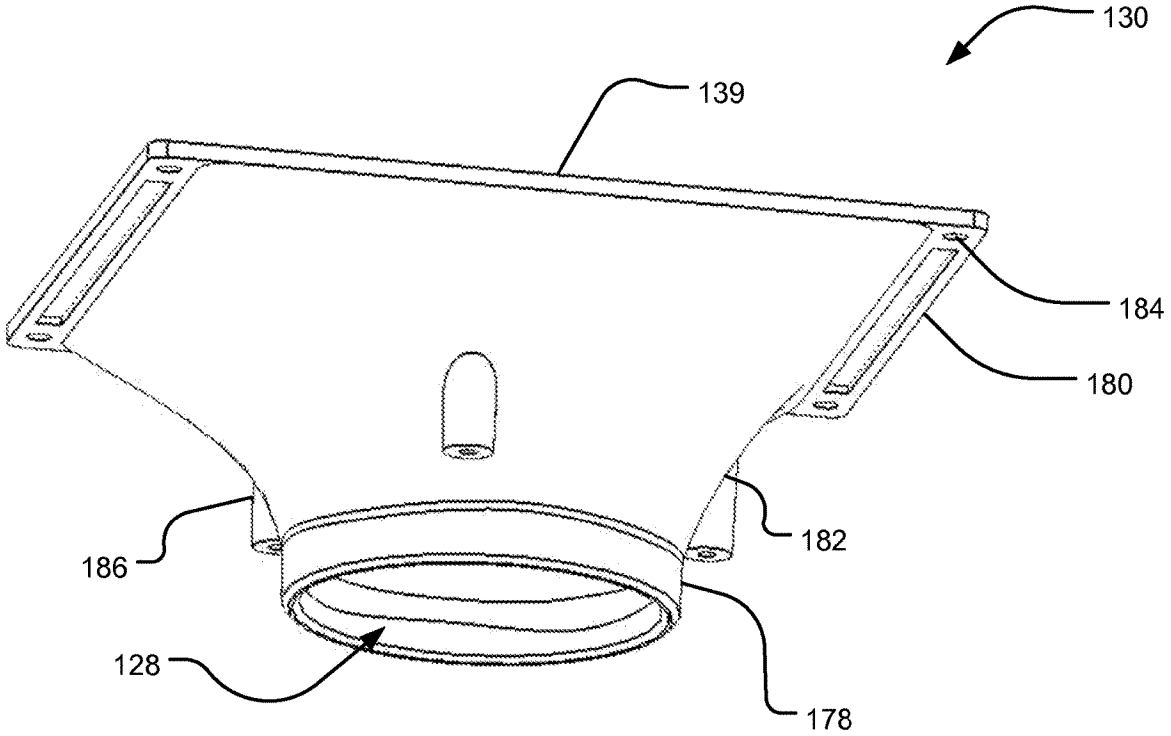
FIGS. 12-13 show a bottom perspective view and a top perspective view, respectively, of the funnel.
Figure 13:
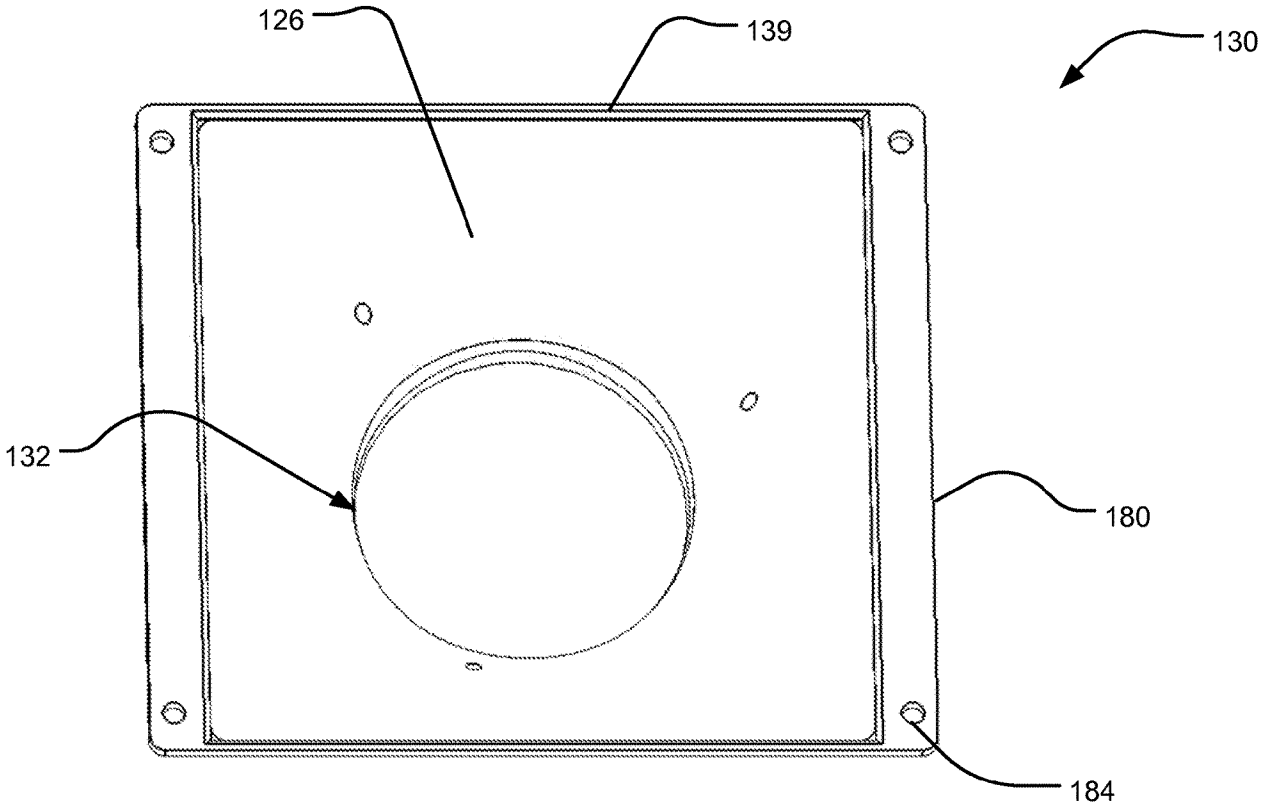
Figure 14:
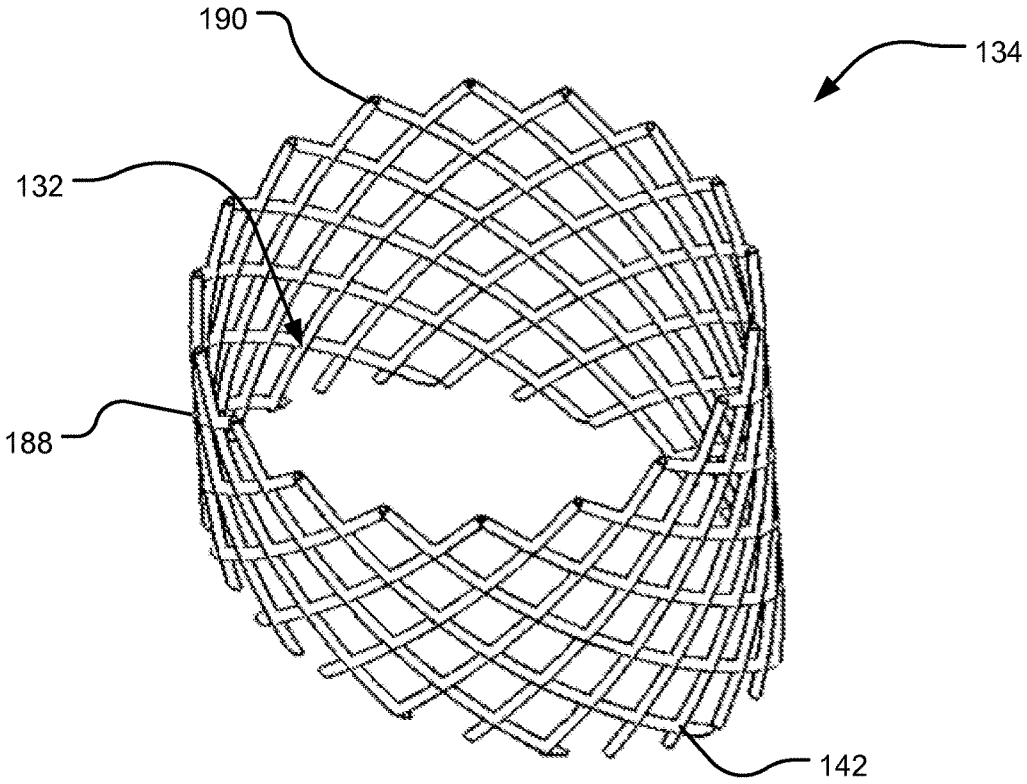
FIG. 14 illustrates a top perspective view of the nozzle.
Figure 15:
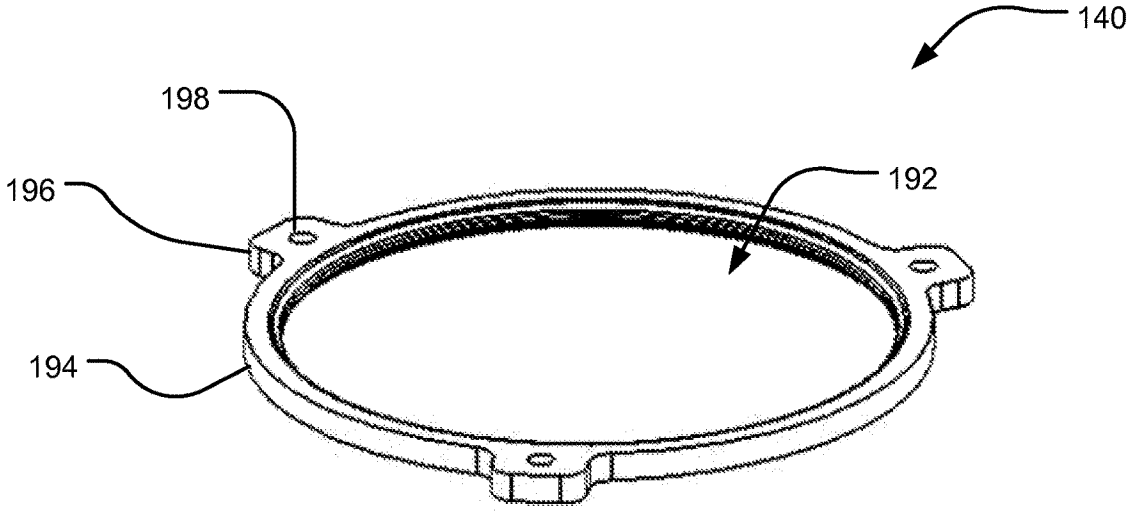
FIG. 15 shows a side perspective view of the ring.

Referring to FIGS. 7 and 8, the coin hopper 136 is depicted with the bin 144 shown and removed, respectively. In one implementation, the bin 144 of the coin hopper 136 includes a sloped surface 162 having an opening 164 defined therein and configured to direct the coins towards the payout disc 168. As can be understood from FIGS. 6-8, in one implementation, the opening 132 of the nozzle 134 is offset from the opening 164 to the payout disc 168, thereby facilitating a controlled release of the coins from the funnel assembly 106 onto the payout disc 168. The payout disc 168 may have a plurality of sockets 170 defining the openings 152 to receive the coins into the coin hopper 136.

The payout disc 168 is rotated by a motor about a center point 174. As the payout disc 168 rotates, the coins are routed into the sockets 170 and through openings 172 for counting and payout. In one implementation, the coil spring 146 includes a coiled portion 156 from which an elongated portion 158 extends to a hooked tip 160. The hooked tip 160 facilitates directing the coins into the sockets 170, and the coiled portion 156 provides flexibility as the hooked tip 160 contacts one or more coins. A coin insert plate 171 hooks each of the coins and directs them to an exit shoot 173 defined in a panel 154 of the coin hopper 136 where they are ejected.

In one implementation, the motor of the coin hopper 136 is powered by a power supply (e.g., a 12 or 24 DC voltage supply) provided via the power connector 120, and the motor draws a current of approximately 2 Amps. The motor may be controlled by a printed circuit board (PCB) and operates the payout disc 168 using gears and shafts. The motor turns the payout disc 168 to provide payout of the coins. In one implementation, the coins are counted at a speed of approximately 6 to 7 coins per second using an optical sensor. Stated differently, all paid out coins pass by the optical sensor indirectly. When a coin appears at a counter pawl under an exit bridge, the PCB controls coin verification with the optical sensor and releases a logic signal verifying a coin. An opto-coupler and the counter pawl detect paid-out coins. The coins are then ejected through the exit shoot 173.

For a detailed discussion of the funnel assembly 106, reference is made to FIGS. 9-15. In one implementation, the funnel assembly 106 includes the funnel 130 connected to the nozzle 134 with the ring 14. The shape of the funnel 130 provides a smooth transition into the nozzle 134 to create a controlled flow of coins.

In one implementation, the funnel 130 includes the rim 139 from which a contoured portion 182 slopes distally to a distal end 178 defining the hole 128. The contoured portion 182 has a diameter that tapers from the rim 139 until meeting the distal end 178. The contoured portion 182 includes the inner surface 126 configured to direct coins toward the distal end 178, where the coins are dropped through the hole 128. In one implementation, the distal end 178 has a cylindrical shape, and the inner surface 126 of the contoured portion 182 transitions smoothly into the cylindrical shape of the distal end 178.

The rim 139 may include one or more end panels 180 having one or more engaging features (e.g., holes 184) configured to engage corresponding features in the bucket assembly 102 to mount the funnel assembly 106 thereto. A screw or similar mechanism may be inserted through each of the holes 184 for receipt in the bucket assembly 102. Similarly, the funnel 130 may include one or more engaging features configured to engage the ring 140. For example, screw holes 186 configured to receive screws to connect the ring 140 may be disposed on the contoured portion 182. It will be appreciated that other engaging features may be used.

The distal end 178 may be inserted into the opening 132 of the nozzle 134, such that the distal end 178 of the funnel 130 is distal to a proximal edge 190 of the nozzle 134. In one implementation, the nozzle 134 includes a body 188 extending from the proximal edge 190 to the distal edge 142. The body 188 may be solid or have a configuration of one or more openings forming the body. For example, the body 188 may comprise a netting formed by a configuration of a plurality of elongated rods that intersect to create a plurality of rectangular openings. The body 188 is made from a flexible, durable material that is configured to disburse the coins, as described herein. The body 188 may be cylindrical in shape with a diameter larger than a diameter of the hole 128 of the funnel 130. In one implementation, the distal edge 142 is angled relative to the proximal edge 190.

In one implementation, the ring 140 includes a body 194 with one or more tabs 196 extending therefrom. The tabs 196 include engaging features (e.g., holes 198) positioned relative to the screw holes 186 of the funnel 130 to mount the ring 140 to the funnel 130 at the contoured portion 182. The body 194 of the ring 140 may have a variety of shapes and sizes configured to mirror the size and shape of the funnel 130, as described herein. For example, the body 194 of the ring 140 may define an opening 192 that is circular, rectangular, elliptical, triangular, polygonal, contoured, and/or angled.

Figure 16:
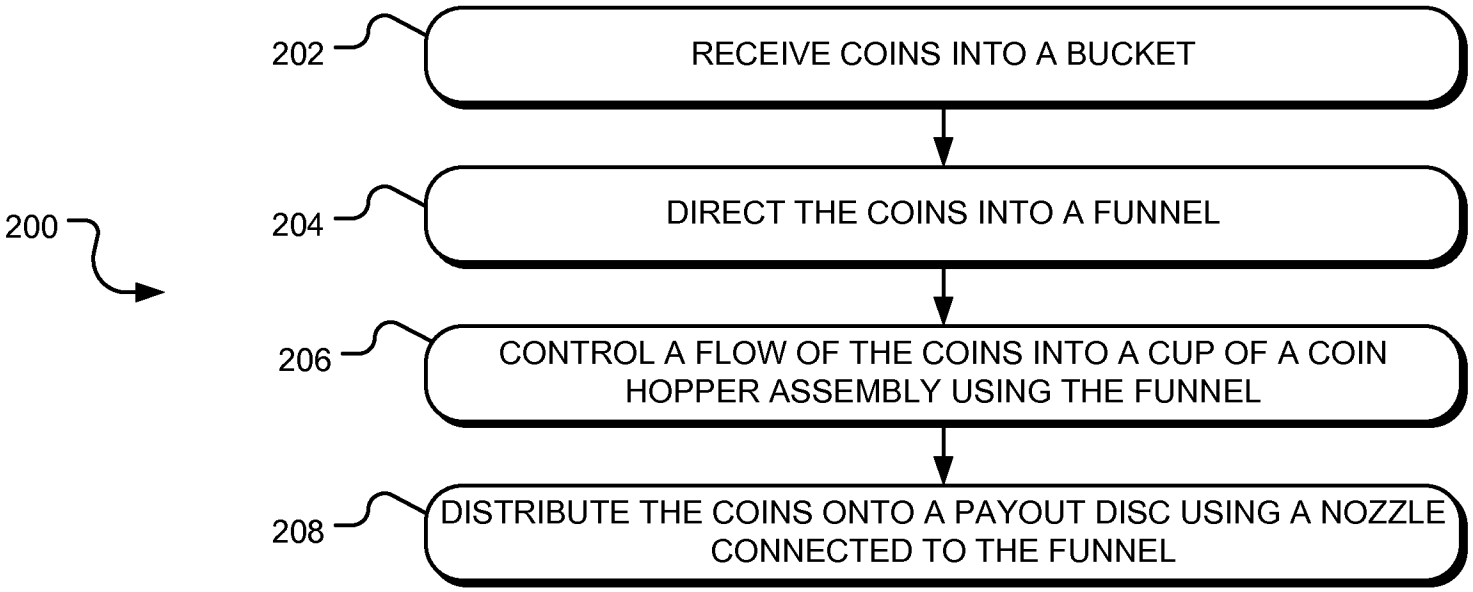
FIG. 16 illustrates example operations for handling an increased coin capacity.

Turning to FIG. 16, example operations 200 for handling an increased coin capacity are illustrated. In one implementation, an operation 202 receives coins into a bucket, and an operation 204 directs the coins into a funnel. An operation 206 controls a flow of the coins into a bin of a coin hopper using the funnel, and an operation 208 distributes the coins onto a payout disc of the coin hopper using a nozzle connected to the funnel.

In the present disclosure, the methods disclosed may be implemented as sets of instructions or software readable by a device. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A machine-readable medium includes any mechanism for storing information in a form (e.g., software, processing application) readable by a machine (e.g., a computer). The machine-readable medium may include, but is not limited to, magnetic storage medium, optical storage medium; magneto-optical storage medium, read only memory (ROM); random access memory (RAM); erasable programmable memory (e.g., EPROM and EEPROM); flash memory; or other types of medium suitable for storing electronic instructions.

The description above includes example systems, methods, techniques, instruction sequences, and/or computer program products that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. An increased capacity coin hopper assembly comprising:

a bucket assembly having an opening through which one or more coins are receivable;

a coin hopper having a payout disc rotatable by at least one motor; and a funnel assembly disposed between the bucket assembly and the coin hopper;

a funnel of the funnel assembly, the funnel including a funnel body, the funnel body having at least one funnel engaging feature;

a ring of the funnel assembly, the ring including a ring body, the ring body having at least one ring engaging feature, the ring body defining a ring opening; and a nozzle of the funnel assembly, the nozzle having a nozzle body defining a nozzle opening, the funnel assembly having a mounted arrangement with the at least one ring engaging feature of the ring mounted to the at least one funnel engaging feature of the funnel, the mounted arrangement of the funnel assembly including the nozzle body and the funnel body disposed in the ring opening with the ring body engaging the funnel body to the nozzle body in an overlapping relationship, the overlapping relationship including the funnel body of the funnel extending distally into the nozzle opening and the nozzle body covering a portion of the funnel body, the nozzle having a distal edge adjacent to the payout disc, the funnel assembly directing the one or more coins from the bucket assembly to the payout disc with a controlled flow, the nozzle generating a distribution of the one or more coins directly onto the payout disc, the distribution including the nozzle hitting at least one stack of the one or more coins disposed on the payout disc.

2. The increased capacity coin hopper assembly of claim 1, wherein the nozzle comprises a flexible material.

3. The increased capacity coin hopper assembly of claim 2, wherein the flexible material is a netting.

4. The increased capacity coin hopper assembly of claim 1, wherein the distal edge of the nozzle extends along an angle relative to a proximate edge of the nozzle.

5. The increased capacity coin hopper assembly of claim 4, wherein the angle is parallel to a surface angle of the coin hopper.

6. The increased capacity coin hopper assembly of claim 1, wherein the funnel includes a contoured portion having an inner surface that slopes distally towards a hole.

7. The increased capacity coin hopper assembly of claim 1, wherein the funnel includes a contoured portion having a diameter that tapers distally towards a distal end of the funnel.

8. The increased capacity coin hopper assembly of claim 1, wherein the nozzle is offset from an opening in a surface of the coin hopper to the payout disc.

9. A method for handling an increased coin capacity, the method comprising:

receiving one or more coins through an opening in a bucket assembly;

directing the one or more coins onto an inner surface of a funnel using one or more angled surfaces of the bucket assembly, the funnel having a funnel body;

controlling a flow of the one or more coins into a bin of a coin hopper with the inner surface of the funnel;

distributing the one or more coins directly onto a payout disc of the coin hopper with a nozzle connected to the funnel with a ring, the ring having a ring body and defining a ring opening, the nozzle having a nozzle body defining a nozzle opening, the ring connecting the nozzle to the funnel in an overlapping relationship with the funnel body extending into the nozzle opening and the nozzle body extending into the ring opening; and hitting at least one stack of the one or more coins disposed on the payout disc with the nozzle.

10. The method of claim 9, wherein the nozzle comprises a flexible material.

11. The method of claim 9, wherein the nozzle has a distal edge that extends along an angle relative to a proximate edge.

12. The method of claim 11, wherein the angle is parallel to a surface angle of the coin hopper.

13. The method of claim 9, wherein the funnel includes a contoured portion having a diameter that tapers distally towards a distal end.

14. The method of claim 9, wherein the nozzle is offset from an opening in a surface of the coin hopper to the payout disc.

15. The method of claim 9, wherein the overlapping relationship includes a distal end of the funnel being inserted through the nozzle opening.

16. An increased capacity coin hopper assembly comprising:

a funnel having a contoured portion sloping distally from a rim to a distal end;

a hole defined by the distal end of the funnel;

a ring having a ring body extending about and defining a ring opening;

a nozzle having a body extending from a proximal edge to a distal edge, the proximal edge of the nozzle connected to the contoured portion of the funnel with the ring body, such that the distal end of the funnel is offset from the proximal edge of the nozzle with the body of the nozzle being in an overlapping relationship with the distal end of the funnel and the body of the nozzle and the body of the funnel are each extending into the ring opening, the distal edge of the nozzle disposed near a surface of a coin hopper; and an opening extending through the body of the nozzle from the proximal edge to the distal edge, the body of the nozzle generating a distribution of one or more coins received in a controlled flow from the contoured portion of the funnel directly onto a payout disc, the distribution including the body of the nozzle hitting at least one stack of the one or more coins disposed on the payout disc.

17. The increased capacity coin hopper assembly of claim 16, wherein the nozzle comprises a flexible material.

18. The increased capacity coin hopper assembly of claim 16, wherein the contoured portion has a diameter that tapers distally towards the distal end.

19. The increased capacity coin hopper assembly of claim 16, wherein the distal end of the funnel has a diameter smaller than a diameter of the opening in the nozzle.

* * * * *